United States Patent [19]

Marchetti

[11] Patent Number: 4,538,398

[45] Date of Patent: Sep. 3, 1985

[54] CARTON SEALING MACHINE WITH SAFETY STOP OF THE CONVEYING BELTS AT THE END OF THE OPERATION

[76] Inventor: Augusto Marchetti, Piazza Sicilia, 7, 20146 Milano, Italy

[21] Appl. No.: 455,829

[22] Filed: Jan. 5, 1983

[30] Foreign Application Priority Data

Jan. 26, 1982 [IT] Italy ..... 19289 A/82

[51] Int. Cl.[3] ..... B65B 1/30

[52] U.S. Cl. ..... 53/493; 53/76; 100/7; 198/627; 198/726; 198/855; 493/117

[58] Field of Search ..... 53/75, 76, 77, 137, 53/374; 156/358, 360, 468, 475, 522; 493/25, 117; 198/627, 726, 855, 856; 100/7

[56] References Cited

U.S. PATENT DOCUMENTS

| | | | |
|---|---|---|---|
| 3,595,369 | 7/1971 | Boulay | 198/726 |
| 4,044,527 | 8/1977 | Ulrich et al. | 53/76 |
| 4,079,573 | 3/1978 | Livingston et al. | 198/856 |
| 4,161,138 | 7/1979 | Marchetti | 198/627 |
| 4,262,469 | 4/1981 | Ooms et al. | 53/76 |
| 4,392,911 | 7/1983 | Ulrich et al. | 198/627 |

*Primary Examiner*—W. D. Bray

*Attorney, Agent, or Firm*—McAulay, Fields, Fisher, Goldstein & Nissen

[57] ABSTRACT

A carton sealing machine for sealing cartons in which a clutch is provided to connect a pair of oppositely disposed conveyor belts for movement thereof from a driving motor. The clutch transmits motion from a driving motor to a pair of approachable conveyor belts, and three sensors are successively arranged along a sealing area to sense the position of advancing cartons advancing through the sealing area; the first sensor is positioned at the inlet of the sealing area to cause a lifting of the sealing head from a lowered rest position, the second sensor is slightly advanced along the path in the sealing area with respect to the first sensor to cause the conveyor belts to move to approach each other in a direction transverse to the direction of carton movement, from a removed rest position, and a third sensor is positioned at the outlet of the sealing area to move the conveyor belts away from the sides of an engaged carton to return the conveyor belts to the removed rest position; and the clutch and the third sensor are operatively connected to cause the disconnection of a driving motor from the conveyor belts for the subsequent stopping thereof, to thereby avoid accidents as a result of conveyor belt movement between sealing operations for sequential cartons.

17 Claims, 5 Drawing Figures

CARTON SEALING MACHINE WITH SAFETY STOP OF THE CONVEYING BELTS AT THE END OF THE OPERATION

BACKGROUND OF THE INVENTION

The present invention relates to a carton sealing machine having conveyor belts with a safety stop therefor at the end of the operation.

Carton sealing machines are known which provide a pair of conveying belts on a support base; the conveyor belts are capable of engaging the carton sides in order to control the advancement of the same cartons along the said base and through a conveniently equipped sealing area for sealing of the cartons.

In such machines the operation of the conveying belts is usually assigned to or under the control of an electric motor, which keeps them in movement by means of a suitable motion transmission mechanism during the whole period of use or operation of the machine.

The object of the present invention is to provide a sealing machine of the above mentioned kind, which, in part for accident prevention and in part for reduction of wear and saving of energy, provides for a stoppage of the conveying belts at the end of every carton sealing operation.

According to the invention such an object is accomplished by providing a sealing machine provided with the motion transmission mechanism which includes a releasable friction device or clutch and at the outlet of the carton sealing area there is disposed a sensor for sensing the disengagement or leaving of a carton from the carton sealing area and at that point in time to control the release of the releasable friction device for the subsequent stopping of the conveyor belts.

The machine according to the invention therefore provides that at the end of every sealing operation a sensor causes and controls a releasable friction device or clutch to render the same operable to stop the conveying belts and stop the carton movement. One is thus assured that between a first sealing operation and the next successive sealing operation, accidents due to the belt movement do not occur and at the same time energy is saved and the wear of the different members in movement is limited.

BRIEF DESCRIPTION OF THE DRAWINGS

A sealing machine according to the invention is illustrated in the accompanying drawings, in which.

DETAILED DESCRIPTION OF THE BEST MODE

Figure 1:
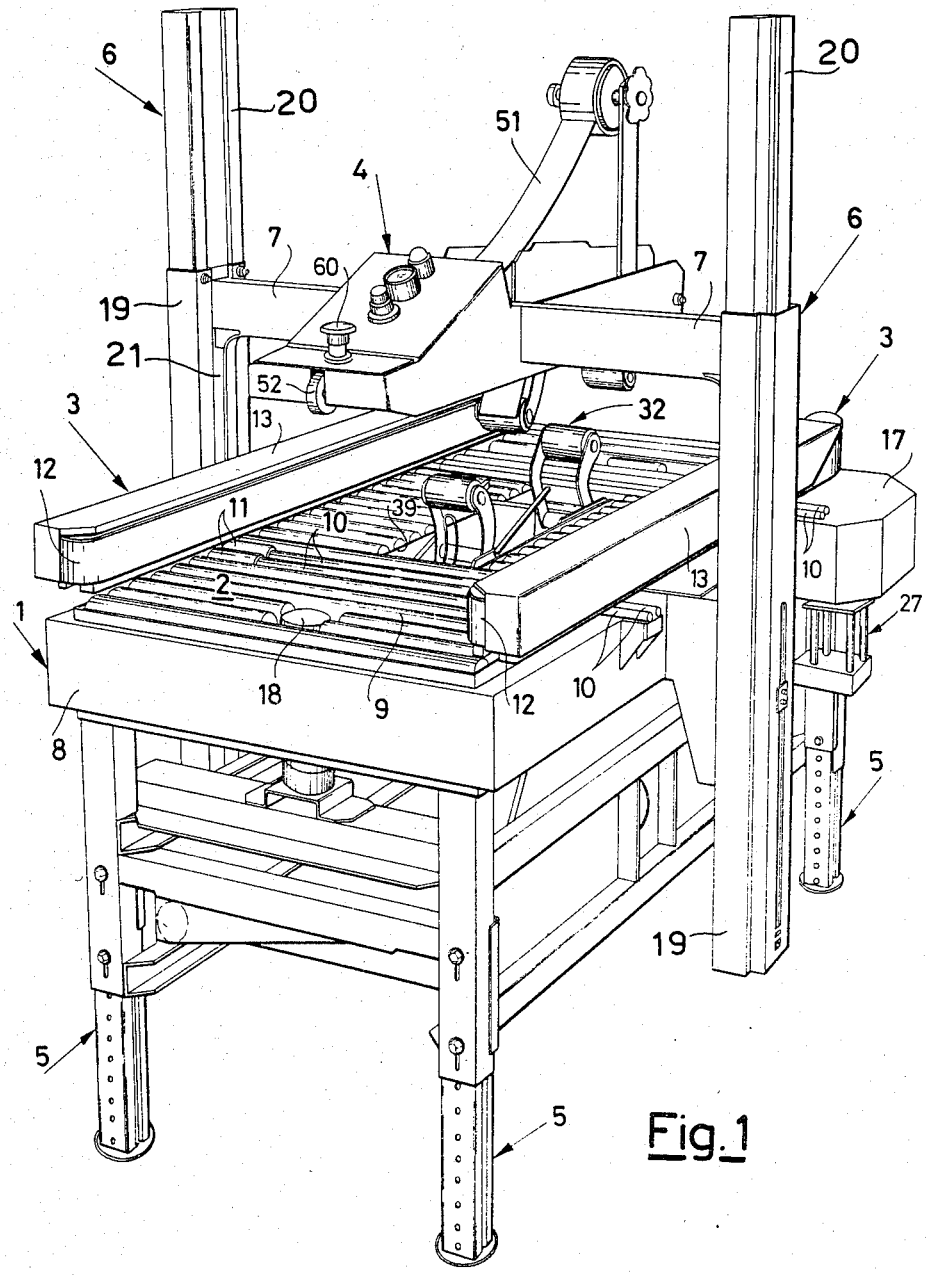
FIG. 1 shows said sealing machine in perspective view.

With reference to FIG. 1, there is illustrated a sealing machine for variable width cartons, which comprises, in general, a roller base 1 defining a support plane or base 2 for the cartons to be sealed, two belt conveying units 3 disposed at the two sides of the support base and approachable or movable towards a central axis of the machine in the direction of carton movement or each other to be engaged with the sides of the cartons for their rectiliner advancement from one end to the other of the support base (from left to right, looking at FIG. 1), a lower sealing unit 32 housed in a space 39 of the base 1, and an upper movable sealing head or unit 4 superimposed above the support plane 2 and positionable thereabove at variable heights. More precisely, the sealing head 4 is normally in a lowered rest position and is temporarily liftable from the rest position at each operation on a carton to be sealed.

Besides, there is provided a support frame, includes a group of four legs 5 destined for the support of the base 1 and a pair of columns 6 extending upwards from the base 1 for the support and guide, through arms 7, of the sealing head 4.

Figure 2:
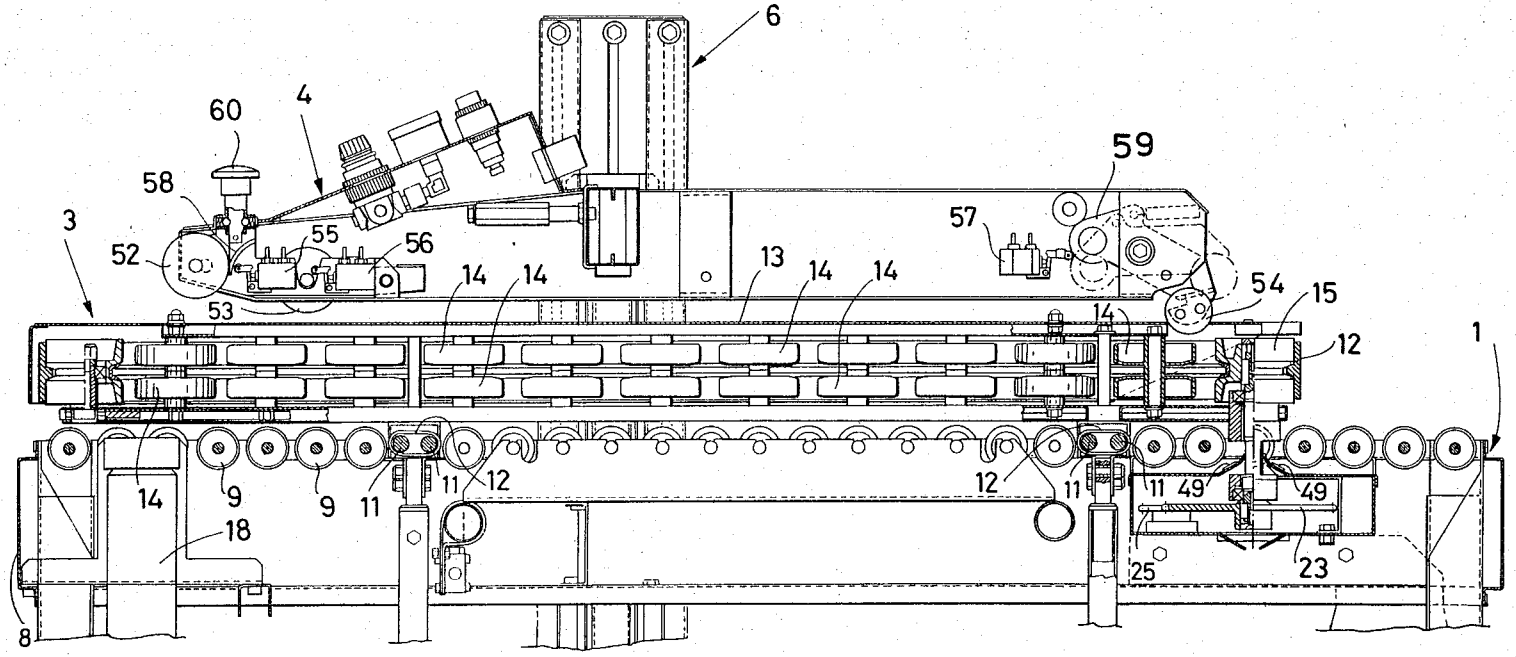
FIG. 2 shows said machine in longitudinal central section.

As can be noted from FIGS. 1 and 2, the base 1 is really constituted by rectangular frame 8 and by a succession of parallel transversal rollers 9 supported in a freely rotating way by the frame 8 in a direction tansverse to the central axis of the machine. Among the various rollers 9 there are also interposed two pairs of cylindrical rods or bars 10, whose ends extend beyond the roller base 1 and are left free from shoulders of base 1 to provide for accident prevention. On every pair of cylindrical bars 10 there are slidingly mounted two pairs of sleeves 11, one for each belt conveying unit 3 which is destined for the support of a respective conveying unit 3 while permitting movement thereof towards and away from each other.

From the same FIGS. 1 and 2 it can also be noted that the conveying units 3 are of the kind known per se, constituted by closed-loop conveying belts 12 disposed around a respective successions of guide pulleys 14, at one end of which a driving pulley 15 is placed (FIG. 2). The two successions of pulleys 14 and 15 and the relative belts 12 are housed inside respective carters 13 supported by the sliding sleeves 11. By controlling the sliding of these latter along the rods 10 by means of a suitable and known device including a pneumatic cylinder 18 (FIG. 1), the two conveying units 3 are therefore approachable to and removable from each other between the removed rest position of FIG. 1 and a variably approached position in which the conveying belts 12 can be engaged, in a known way too, with the carton sides to cause the advancement thereof through the sealing area defined by the upper sealing head 4 and by the lower sealing unit 32.

Figure 3:
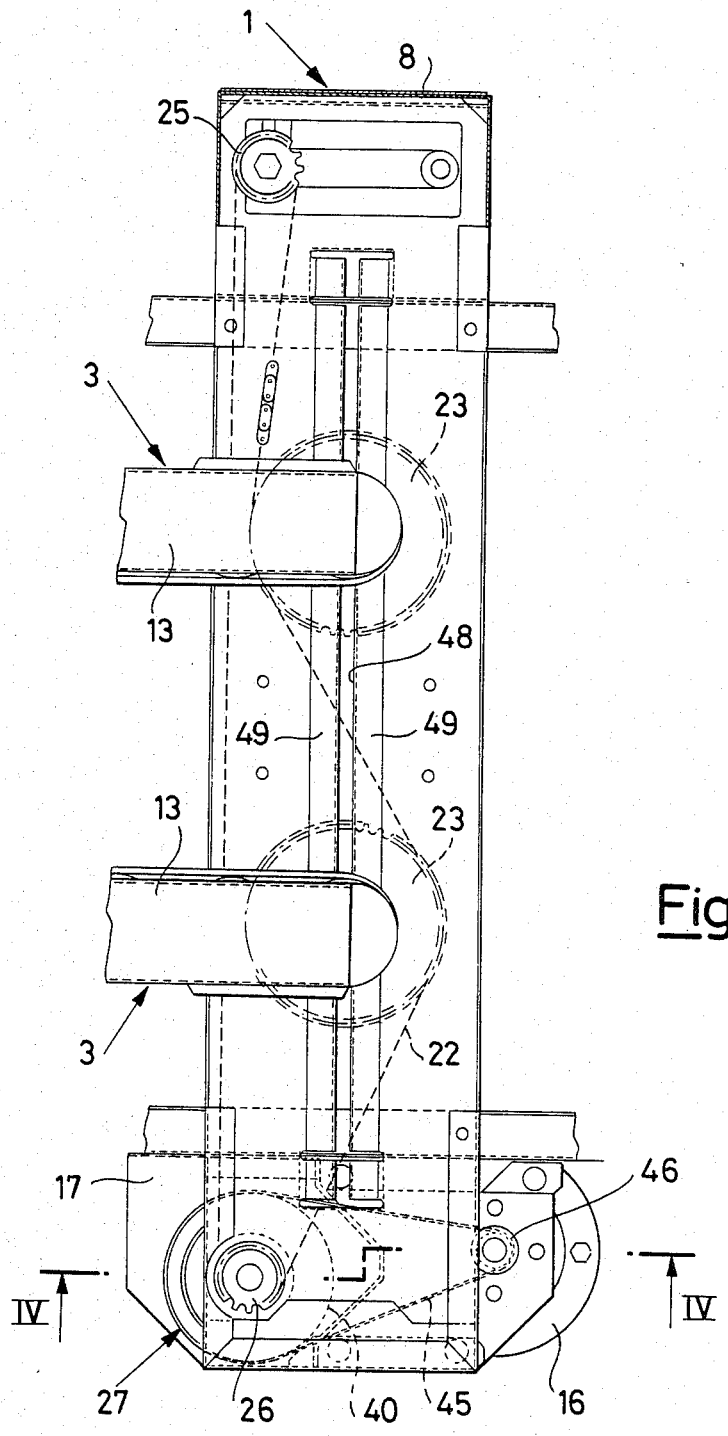
FIG. 3 shows in top plan the outlet part of the above mentioned machine.

For the rotation of the drive pulleys 15 there is provided a single electric motor 16 housed in a fixed carter 17 (FIG. 1) and operatively connected to the above mentioned pulleys 15 by means of a motion transmission mechanism or system, which in general reproduces that described in the U.S. Pat. No. 4,161,138 of which the Applicant of the present invention is the owner. Such motion transmission mechanism or system can be noted from FIGS. 3 and 4 and substantially comprises a closed-loop chain 22 engaged at opposite sides with two toothed gears 23 mounted on the same axes 24 (passing through) a slit 48 limited by movable lips 49) of the driving pulleys 15, so that the chain movements can cause opposite rotations of the toothed gears 23 and consequently mutual approaching and removal movements of the conveying units 3. The chain 22 is also engaged with a tensioning sprocket 25 and with a control pinion 26 rotated by the motor 16 through a pneumatic-control releasable clutch or friction device 27.

Figure 4:
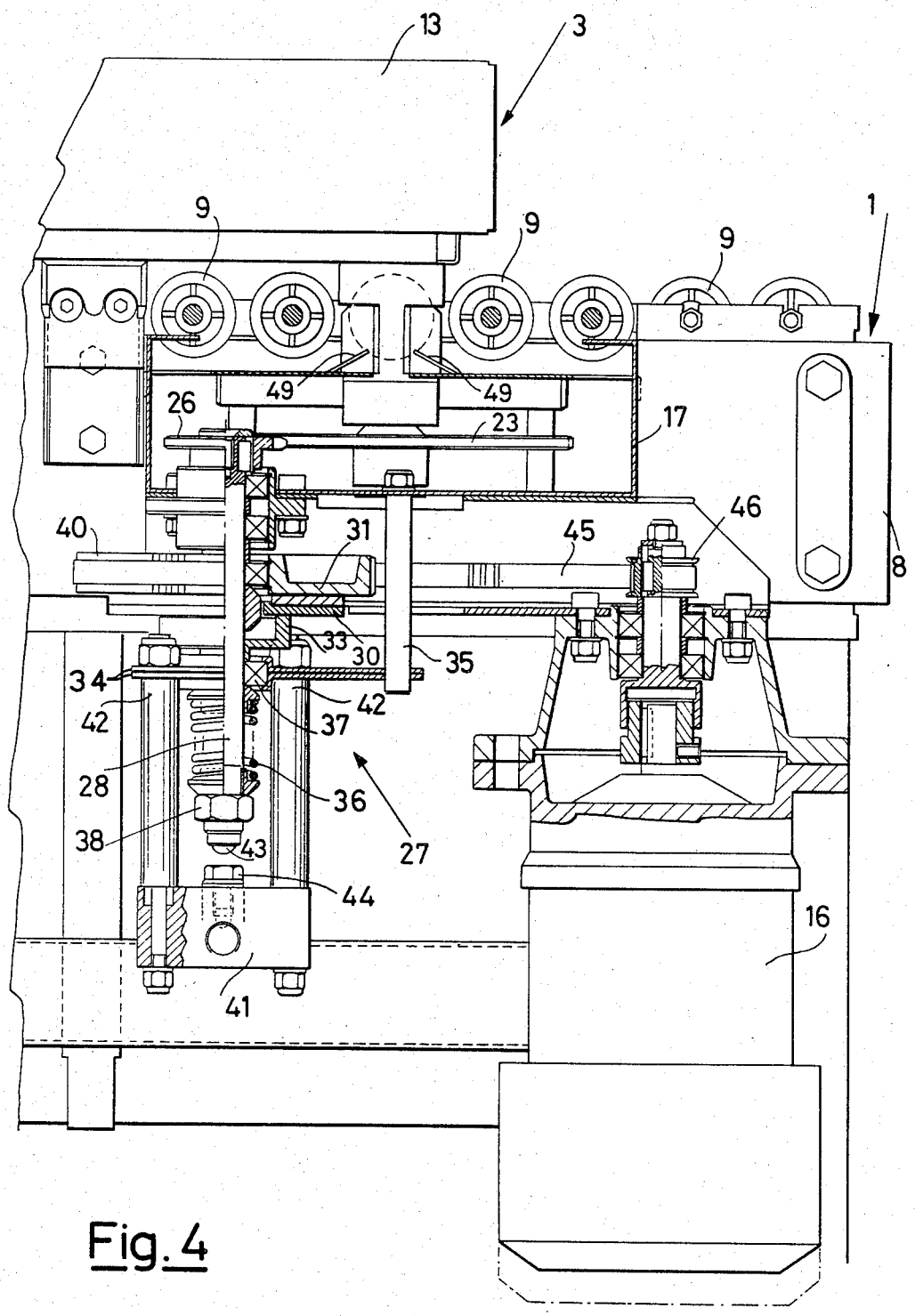
FIG. 4 shows said part of the machine in section along line IV—IV of FIG. 3.

More precisely, as shown in FIG. 4, the pinion 26 is connected for rotation to a support stem 28, with which there integrally rotates a hub 29, on which there is mounted in an axially sliding, but integrally rotating way, a disk 30 which carries friction material 31. The disk 30 is supported by a cup-shaped support 33 and support 33 in its turn in rotatably supported by means of a bearing 37 and by a pair of integral plates 34 which are vertically slidable coaxially and under the guide of the stem 28 and vertically slidable along a centering pin 35. A spring 36 is wound around the stem 28 and reacts or is spring engaged between the bearing 37 and a nut 38 which nut 38 is mounted on the lower end of the stem 28 for urging or stressing the disk 30 upwards and towards and into friction engagement with a superimposed toothed pulley 40 mounted in a freely rotating way on and relative to the stem 28; from such friction engagement between disc 30 and toothed pulley 40, the disk 30 on the other hand can be moved away, when required, by means of a pneumatic cylinder 41, which on one end is fixed to the pair of plates 34 through by means of columns 42 and on the other hand is able to abut with and then to react against the lower end of stem 28 which is provided with a centering sphere 43. The centering sphere cooperates with a nut 44 which is constructed, arranged and suitable for receiving the sphere or spherical portion 43. A toothed belt 45 connects a toothed pulley 46 to toothed pulley 40 of friction device 27 to provide for coupling between the toothed pulley 40 thereof and the toothed pulley 46 which is mounted directly on the shaft 47 of the motor 16.

As previously set forth, the sealing head 4 is supported and guided in its vertical movements by a pair of columns 6 supported by the base 1. More precisely, the sealing head 4 is connected by the arms 7 to respective slides 21 slidingly housed inside respective fixed parts 19 of the columns, above which adjustable projections 20 extend. Inside the above mentioned fixed parts 19 there are also housed respective pneumatic cylinders destined for the brief lifting of the head 4 when required. Said pneumatic cyclinders are indicated with the reference number 50 in the pneumatic scheme of FIG. 5 with reference to which the working will be described.

Figure 5:
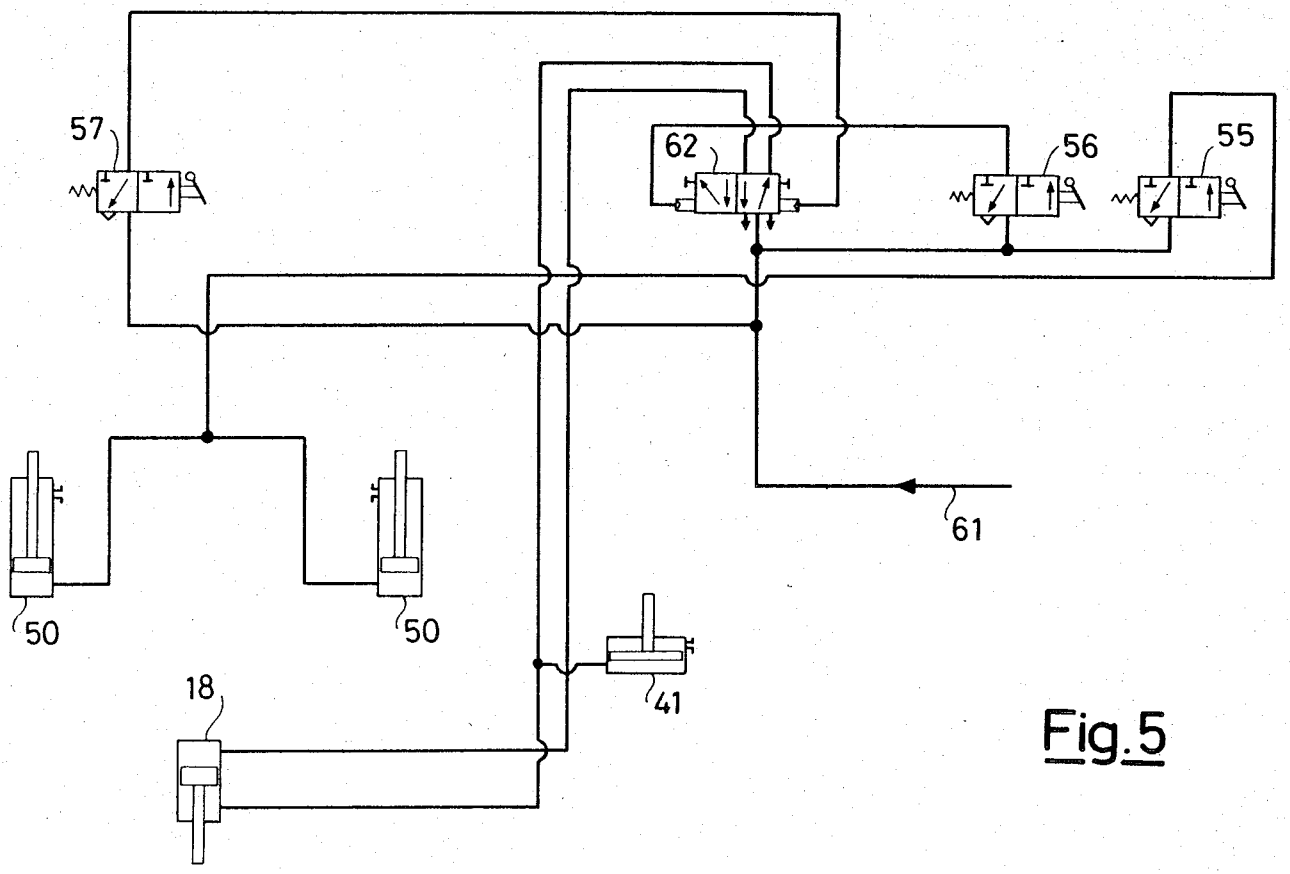
FIG. 5 shows the basic scheme of the control pneumatic circuit of the above mentioned machine.

The sealing head 4 comprises in its turn, in addition to the usual members for the support and the application of a sealing tape 51 (FIG. 1), a series of sensors 52, 53 and 54 connected to respective pneumatic valves 55, 56 and 57 illustrated in FIG. 2 and shown in the pneumatic scheme of FIG. 5. As one can see from FIG. 2, the sensor 52 is placed at the inlet of the sealing area to detect the arrival of a carton front and in such case to conrol the activation of the valve 55 through a flat spring 58, the sensor 53 is placed a little more ahead to detect the presence of the top of the same carton under the sealing head and to control in such case the movement or activation of the valve 56, and the sensor 54 is finally placed at the outlet of the sealing area to control through a level 59 and a unidirectional articulated arm the movement or activation of the valve 57 during the passage of the carton top.

The machine illustrated in the drawings finally comprises a pneumatic control circuit (FIG. 5), which uses a compressed air feed 61 and also includes a two-position distributing valve 62, the control of which is provided from time to time by the valves 56 and 57. According to the controlled position, the above mentioned distributing valve provides to operate in one way or another the two pneumatic cylinders 18 and 41. The position of the valve 55 on the contrary controls the operation of the pneumatic cylinders 50.

OPERATION

By the effect of the described structure, the sealing machine is intended to operate as follows. At rest or in an inactive condition, the distributing valve 62 is in the position of FIG. 5, and the compressed air fed or coming from line 61 causes the pistons of the cylinders 18 and 41 to control the belt conveying units 3 to keep them separated from each other and disengaged from a package. The second piston-cylinder 41 has its piston kept to move support stem 28 to be lowered into a position such as to cause, reacting of pneumatic cylinder 41 against the lower end of the stem 28 (FIG. 4), and therefore the friction disk 30 is lowered or moved out of contact with pulley 40 for the functional separation of the pinion 26 from gears 23, and consequently of the separation of conveying belts 12, from the pulley 40 and consequently from the motor 16; the motor 16 therefore rotates, but the conveying belts are immovable. The rest position or inactive state of the valve 55 on the other hand keeps the cylinders 50 in the lowered position to which corresponds the lowering of the sealing head 4 (stressed by its own weight) in an opportunely chosen rest position.

During the introduction of a carton to be sealed, the front wall thereof is caused to make contact with and lay against the inlet sensor 52, which cause the activation of the valve 55. Compressed air upon activation of valve 55 is consequently fed to the cylinders 50, which cause the raising of the sealing head 4 up to the end of the engagement between the carton and the sensor 52. While the carton is still manually being made to advance, then the sealing head goes down by gravity up to the point to position or lay the sensor 53 on the carton top (with upper flaps of the carton in closed position). The consequent activation of the valve 56 causes in its turn the activation of the distributing valve 62, which controls the operation of the cylinder 18 in the direction of closure of or moving together of the conveying units 3 and at the same time cuts off the feeding to the clutching or cylinder 41, thus causing the friction connnection or engagement of the pulley 40 with the friction material 31 on disk 30 and therefore with the pinion 26 and, finally, connecting the motor 16 to the driving pulleys 15 of the conveying belts 12. By the belts 12 engaging with the carton sides, the belts 12 can thus cause the advancement of the carton through the sealing area for the application of adhesive tapes on the top and on the bottom of the carton.

The carton is subsequently engaged with the outlet sensor 54, which, due to the articulated arm interposed between the lever 59 and the valve 57, has no effect on the valve 57, which therefore remains in the rest position shown in FIG. 5.

Nothing happens upon the release of the sensor 53, while on the contrary it is important the following release of the outlet sensor 54. In fact this causes the brief activation of the valve 57 and the consequent activation of the distributing valve 62, which places valve 62 in the rest position of FIG. 5, and causing through the cylinder 18 the separation or opening of the conveying units 3 to release the hold on the carton and through the cylinder 41 the release of the friction device or clutch 27 for the consequent stoppage of the conveying belts 12. The sealing head 4 in its turn goes down by gravity to the starting position of minimum height.

I claim:

1. A carton sealing machine for sealing cartons, comprising:

a support base for the cartons;

a movable sealing head movable relative to said base and positionable at variable heights above said base to define with said base a carton sealing area;

driving means for lifting said movable sealing head from a lowered rest position;

conveyor means arranged at opposite sides of said base and movable in a direction towards each other to approach each other from a removed rest position to a carton engaged position, said conveyor means in said rest position being disengaged from opposite sides of the carton and in said engaged position being engaged with opposite sides of the carton for the advancement thereof along a path on said base through said sealing area;

a driving mechanism for said conveyor means;

motion transmission means including a clutch for transmitting the motion from said driving mechanism to said conveyor means in an engaged condition of said clutch and to disconnect said driving mechanism from said conveyor means in a disengaged condition of said clutch; and a plurality of sensing means successively arranged along said sealing area to sense the position of an advancing carton advancing through said sealing area, said sensing means including a first sensor positioned at the inlet of said sealing area to cause a lifting of said sealing head from said lowered rest position, a second sensor slightly advanced along the path in said sealing area with respect to said first sensor to cause said conveyor means to move to approach each other to reach said engaged position from said removed rest position, and a third sensor positioned at the outlet of the sealing area to move said conveyor means away from the sides of an engaged carton to return said conveyor means to said removed rest position, and said third sensor being operatively connected to said clutch to cause the disconnection of said driving mechanism from said conveyor means for the subsequent stopping thereof.

2. A machine according to claim 1, wherein said sensors are mounted on said sealing head.

3. The machine according to claim 1, wherein said first sensor is operatively associated with said driving means for causing thereof to lift said movable sealing head.

4. The machine according to claim 1, wherein said clutch includes a toothed pulley cooperating with a disc axially slidable along a support stem for engagement with and disengagement from said toothed pulley, said disc including friction material thereon positioned between said toothed pulley and said slidable disc during engagement therebetween.

5. The machine according to claim 4, including elastic means on said support stem for urging said toothed pulley and said friction material on said disc into engagement with each other.

6. The machine according to claim 5, including another toothed pulley coupled with said driving mechanism, a toothed belt coupling said first-mentioned toothed pulley and said other toothed pulley, said elastic means on said support stem causing said disc and said first-mentioned toothed pulley to be engaged for transmission of motion to said conveyor means from said driving mechanism.

7. The machine of claim 1, wherein said third sensor causes said sealing head to be lowered to its said lowered position by said driving means.

8. The machine of claim 1, wherein said first sensor is an inlet sensor which activates said driving means to raise said sealing head from its said lowered position to a raised position against the end of said inlet sensor.

9. The machine of claim 1, including a pneumatic valve for each said sensor, and a flat spring cooperating with the pneumatic valve for said first sensor to cooperate with said first sensor to control the activation of said last-mentioned pneumatic valve.

10. The machine according to claim 1, wherein said clutch includes elastic means for urging said driving means into cooperative engagement with said conveyor means.

11. The machine according to claim 1, including a first toothed pulley operatively associated with said clutch, a second toothed pulley coupled with said driving mechanism, a toothed belt coupling said first toothed pulley and said second toothed pulley, and elastic means associated with said clutch for causing said conveyor means to become engaged with said driving mechanism through said first toothed pulley for transmission of motion to said conveyor means from said driving mechanism through said second pulley.

12. A machine according to claim 9, wherein said sensors are mounted on said sealing head.

13. The machine according to claim 9, wherein said first sensor is operatively associated with said driving means for causing thereof to lift said movable sealing head.

14. The machine of claim 9, wherein said third sensor causes said sealing head to be lowered to its said lowered position by said driving means.

15. The machine of claim 9, wherein said first sensor is an inlet sensor which activates said driving means to raise said sealing head from its said lowered position to a raised position against the end of said inlet sensor.

16. The machine of claim 9, including a pneumatic valve for each said sensor, and a flat spring cooperating with the pneumatic valve for said first sensor to cooperate with said first sensor to control the activation of said last-mentioned pnuematic valve.

17. The machine according to claim 1, wherein said clutch includes a friction disc and elastic means, said disc being axially slidable along a support stem for placing said conveyor means into operative engagement with and disengagement from said driving mechanism, and said elastic means urging said disc into operative engagement, and pneumatic means associated with said disc for urging thereof to overcome said elastic means for movement of said disc out of operative engagement with said driving mechanism.

* * * * *

UNITED STATES PATENT AND TRADEMARK OFFICE

CERTIFICATE OF CORRECTION

PATENT NO. : 4,538,398

DATED : September 3, 1985

INVENTOR(S) : Augusto MARCHETTI

It is certified that error appears in the above—identified patent and that said Letters Patent is hereby corrected as shown below:

Column 2, line 61, "through)" should be --through--.

Column 3. line 7, "in" (second occurence) should be --is--.

Column 3, line 59, "level" should be --lever--.

Signed and Sealed this

*Sixth* Day of *May 1986*

[SEAL]

*Attest:*

DONALD J. QUIGG

*Attesting Officer*

*Commissioner of Patents and Trademarks*